US008681773B2

(12) United States Patent
Chazel et al.

(10) Patent No.: US 8,681,773 B2
(45) Date of Patent: Mar. 25, 2014

(54) METHOD FOR ROUTING DATA BETWEEN AT LEAST ONE GUIDED VEHICLE AND A GROUND NETWORK

(75) Inventors: Anne-Sophie Chazel, Le Plessis-Robinson (FR); Raphaëlle De Lajudie-Dezellus, Paris (FR)

(73) Assignee: Siemens S.A.S., St. Denis (FR)

( * ) Notice: Subject to any disclaimer, the term of this patent is extended or adjusted under 35 U.S.C. 154(b) by 335 days.

(21) Appl. No.: 13/124,812

(22) PCT Filed: Oct. 27, 2008

(86) PCT No.: PCT/FR2008/001509

§ 371 (c)(1),
(2), (4) Date: Jun. 2, 2011

(87) PCT Pub. No.: WO2010/049595

PCT Pub. Date: May 6, 2010

(65) Prior Publication Data

US 2011/0222426 A1 Sep. 15, 2011

(51) Int. Cl.
*H04L 12/26* (2006.01)

(52) U.S. Cl.
USPC ..... 370/351

(58) Field of Classification Search
None
See application file for complete search history.

(56) References Cited

U.S. PATENT DOCUMENTS

| | | | | |
|---|---|---|---|---|
| 7,697,449 | B1 * | 4/2010 | Shirali et al. | 370/252 |
| 2003/0043741 | A1 * | 3/2003 | Mukai et al. | 370/229 |
| 2003/0158637 | A1 * | 8/2003 | Johnson | 701/19 |
| 2005/0208924 | A1 | 9/2005 | Ohaku et al. | |
| 2005/0249157 | A1 * | 11/2005 | Qian et al. | 370/329 |
| 2008/0020768 | A1 * | 1/2008 | Li et al. | 455/436 |
| 2008/0232399 | A1 * | 9/2008 | Groleau et al. | 370/468 |
| 2009/0036062 | A1 * | 2/2009 | Tanaka et al. | 455/69 |
| 2009/0063700 | A1 | 3/2009 | De Lajudie et al. | |
| 2009/0219900 | A1 | 9/2009 | Kokkinen et al. | |
| 2009/0270112 | A1 | 10/2009 | Sawada et al. | |
| 2010/0130245 | A1 * | 5/2010 | Iseda | 455/522 |

FOREIGN PATENT DOCUMENTS

| | | | |
|---|---|---|---|
| CN | 101239623 | A | 8/2008 |
| EP | 1237389 | A2 | 9/2002 |
| EP | 1727311 | A1 | 11/2006 |
| WO | 2007060084 | A1 | 5/2007 |
| WO | 2007063168 | A1 | 6/2007 |
| WO | 2007107424 | A1 | 9/2007 |

* cited by examiner

*Primary Examiner* — Chirag Shah
*Assistant Examiner* — Sun Jin Kang
(74) *Attorney, Agent, or Firm* — Laurence A. Greenberg; Werner H. Stemer; Ralph E. Locher

(57) ABSTRACT

A method for routing data between at least one guided vehicle and a ground network, wherein said vehicle moves on a track between at least a first and a second communication terminal arranged on the ground along the track. The terminals are capable of exchanging data streams between a ground network and at least one routing module onboard the vehicle. A transmission quality measurement for a first signal between the first terminal and the routing module is carried out periodically, a transmission quality measurement for a second signal between the second terminal and the routing module is carried out periodically, a measurement of the available data flow rate for the first signal between the ground network and the routing module is carried out periodically, a measurement of the available data flow rate for the second signal between the ground network and the routing module is carried out periodically, a routing path for at least a portion of the data between the ground network and the routing module is also periodically determined via at least one of the communication terminals if it has a measured signal quality higher than a predetermined threshold and a data flow rate higher than a predetermined threshold.

9 Claims, 4 Drawing Sheets

METHOD FOR ROUTING DATA BETWEEN AT LEAST ONE GUIDED VEHICLE AND A GROUND NETWORK

BACKGROUND OF THE INVENTION

Field of the Invention

The invention relates to a method for routing data between at least one guided vehicle and a ground network The vehicle moves on a track between at least a first and a second communication terminal disposed on the ground along the track, said terminals being capable of exchanging data streams between a ground network and at least one routing module on board the vehicle.

By "guided vehicle", the invention means in particular public transport methods such as trains, subways, tramways, trolley-buses, buses, etc. and, more particularly, rail vehicles or rubber-tired vehicles running on guideways/rollways, and with central guide-rail traction, the trajectory of which is implemented by a single central metal rail between two rollways of the rubber-tired wheels. The vehicle guidance may be automatic (without the need for a driver on board the vehicle, but using an onboard control system itself linked to a ground communication network for its control) or manual. The invention may also be applied for any other means of transport by land, water or air.

Radio connections between a ground communication network and a guided train are effected between transmission/receiving communication terminals on the ground and transmitters/receivers on board. The onboard transmitters/receivers are themselves connected to an onboard communication network comprising at least one data traffic management router within, alongside and outside the vehicle. In a vehicle of elongated shape such as a bus or an assembly of coupled vehicles such as a train, at least two routers are generally disposed on both sides of said vehicle or train and connected to the radio transmitters/receivers for the purpose of facilitating communication with one or other of the communication terminals disposed on the ground along the track.

According to this scheme, therefore, a routing path combined with a radio channel is generally used. This channel may thus have limits in available capacity, for example in terms of throughput rate, and may therefore delay or even prevent the correct implementation of such applications that are required for transmission of video data (high throughput rate required), audio data or critical data. In a high mobility environment, physical conditions for transmission of data may also change very quickly; in particular, the presence of another, so-called "masking" vehicle may diminish or even prevent a communication signal between a vehicle and a communication terminal on the ground.

One solution to this type of dual problem relating to output rate/masking is to bring the communication terminals on the ground closer. This inevitably has an impact on the complexity of implementation of such an installation and, of course, on its cost.

BRIEF SUMMARY OF THE INVENTION

One object of the present invention, therefore, is to propose a data routing method (via radio transmission) with a wide range of throughput rates between at least one vehicle and a ground network, without the need to modify the existing infrastructure of the onboard communication elements such as communication terminals disposed on the ground and forming an interface between the vehicle and the ground network. This routing method must likewise use all of the available communication capacity of the infrastructure implemented, for example in terms of quality, throughput, security, etc.

Another object of the present invention is, according to the various throughput rates required for data transmissions such as those mentioned above, to ensure reliable dynamic routing (and therefore to ensure the availability of the link) with regard to the problem of masking by other vehicles or obstacles between a vehicle and at least one communication terminal.

The present invention thus offers a method for routing data between at least one guided vehicle and a ground network, wherein said vehicle moves on a track between at least a first and a second communication terminal disposed on the ground along the track as claimed.

The advantages of the invention are also presented in a set of subclaims.

Thus, on the basis of a method for routing data between at least one guided vehicle and the ground (implying a means of communication on the ground such as a ground network), wherein said vehicle moves on a track between at least a first and a second communication terminal disposed on the ground along the track, said terminals being capable of exchanging data streams between a ground network and at least one routing module on board the vehicle, said method comprises the following stages:

- a transmission quality measurement for a first signal between the first terminal and the routing module is carried out periodically,
- a transmission quality measurement for a second signal between the second terminal and the routing module is carried out periodically,
- a measurement of the available data throughput rate for the first signal between the ground network and the routing module is carried out periodically,
- a measurement of the available data throughput rate for the second signal between the ground network and the routing module is carried out periodically,
- at least one routing path for at least a portion of the data between the ground and the routing module is also periodically determined by at least one of the communication terminals if it has a measured signal quality higher than a predetermined threshold and a data throughput rate higher than a predetermined threshold.

In other words, according to measurements relating to quality and throughput rate, an initial routing of data is periodically redistributed selectively to at least one of the two terminals, whilst also selectively channeling the data to one or other path according to the throughput rates of said data. It should be noted that, advantageously, this method does not require any material infrastructure in addition to that which already exists. At most, use is made of a normal rerouting algorithm such as one based on known mesh network techniques (according to the MESH-type standard under the OLSR protocol). These algorithms may be applied autonomously in an onboard calculation unit, itself in communication with the one or more routing means onboard in the vehicle or train.

Thus any troublesome masking artifacts could be dynamically bypassed as required by a plurality of routing paths, if this should be necessary for an affected vehicle.

In particular, the present method also highly advantageously provides for the preceding dynamic routing to extend to the creation of paths using vehicles that may have a masking effect as new intermediate bridging terminals between the vehicle affected by the inventive method and one of the intended communication terminals.

In practice, if the track is frequented by at least one said masking vehicle such that said masking vehicle is between the vehicle thus masked from one of the communication terminals and said terminal, the routing path is diverted via a second routing module on board the masking vehicle, said second routing means being selected under conditions such that:

- a transmission quality measurement of a third signal between said second routing means and the communication terminal produces a measured signal quality higher than a predetermined threshold, and
- a measurement of the available data throughput rate of the third signal between the ground network and the second routing module produces a data throughput rate higher than a predetermined threshold.

These additional stages of the inventive method may be applied advantageously to several masking vehicles, and—as soon as sufficient routing conditions are brought together—the transmission may be validly effected using a plurality of paths. According to the different ranges of throughput rates available via one or other, validated route, data with different throughput rates (for example video, audio, critical data) is selectively and individually rerouted (or transmitted) over these paths, in order finally to reach the communication terminal(s) on the ground without obstacle or delay (or vice-versa if the inventive method is applied to the routing elements on the ground in which the aforementioned algorithms are implanted in order to search for routing paths from a terminal to a vehicle).

Thus the routing path, according to a highly flexible dynamic, may be subdivided into several simultaneous and distinct data paths, each of whose bandwidths is dependent on values measured by their transmission quality and their minimum guaranteed throughput rate.

In order to optimize the selection between data type (throughput rate) and possible paths, the data transmitted is already pre-divided into various data types having different throughput rate ranges, such as critical vehicle or traffic data, video data or audio data. This precaution may be taken at the level of the routing means. Thus, depending on the data type, each routing module dynamically divides a data transmission into different routing paths, choosing said paths according to their available transmission capacity and throughput rate demanded by each of the data types to be transmitted.

For each of the routing paths used, one routing path (independently of the other routes) may be channeled via at least one radio relay on board vehicles moving between the two communication terminals.

Within the context of the present invention, routing algorithms on possible paths according to a service quality measurement may thus be associated with data stream distribution algorithms that respond to types of application requiring critical data throughput rates. One or other of the possible paths may therefore be adequately privileged according to the type of stream required.

Currently, data traffic passes through one side of a train and the throughput rate offered to a user (=onboard communication device or passenger's mobile means of communication) corresponds to a throughput rate available within the range limits. Thanks to the inventive method, the throughput rate offered to the user may be greatly augmented since "tailor-made" resources may be utilized at a precise moment, either by offering a link adapted to a high required throughput rate, or by offering a link adapted to a low required throughput rate, or—in the latter case—two routes may be used simultaneously with the load being shared equally by the communication network.

In particular, the inventive method makes it possible, highly advantageously, to envisage a routing path being subdivided into several separate paths on which redundant data is transmitted. This aspect, which relates to security and the need for very high availability, is fundamental to the proper control of the vehicles, in particular in the case of guided (i.e. driverless) vehicles.

It is also possible to envisage that one of the communication terminals a priori on the ground might actually be disposed in an additional vehicle which is itself "disposed" on the ground. In fact, current guided vehicles have all manner of communication terminals on board. In this sense, therefore, it is well worth proposing that the inventive routing method be used in order to route data between a first vehicle and a second vehicle, and to implement the data in applications linked to the vehicles. The inventive routing method, in addition to its aspect of communication between a vehicle and a ground network, therefore provides a possible use for routing data transmitted between several vehicles. The applications are numerous in this sense, for example to ensure more reliable transmission of information and safety data indicating distances between self-guided vehicles to prevent collisions between them.

Exemplary embodiments and applications are provided with the aid of the figures described below:

DESCRIPTION OF THE INVENTION

Figure 1A:
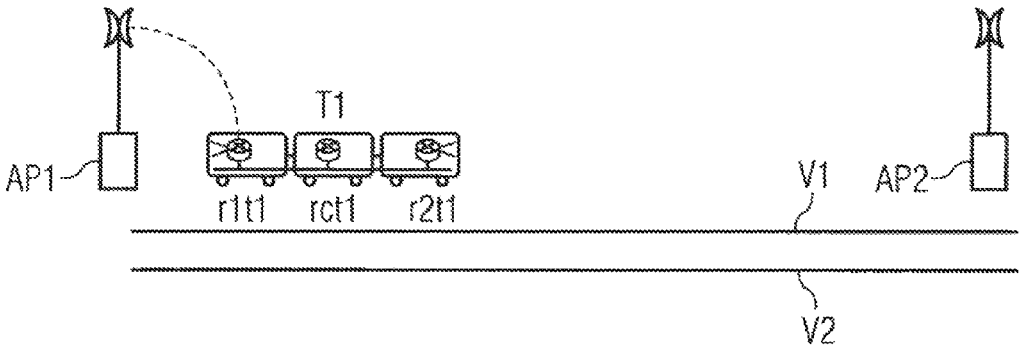
FIGS. 1A, 1B, 1C: Routing method according to the invention via several paths for a vehicle, FIG. 2 Routing method according to the invention for applications with a high throughput rate for a vehicle and masking vehicles, FIG. 3 Routing method according to the invention subject to bandwidth occupation criteria for a vehicle and masking vehicles, FIGS. 4A, 4B, 4C Routing method according to the invention with routing management for various data throughput rates for a vehicle, FIGS. 5A, 5B, 5C Routing method according to the invention with routing management for various data throughput rates for a vehicle and relay vehicles.
Figure 1B:
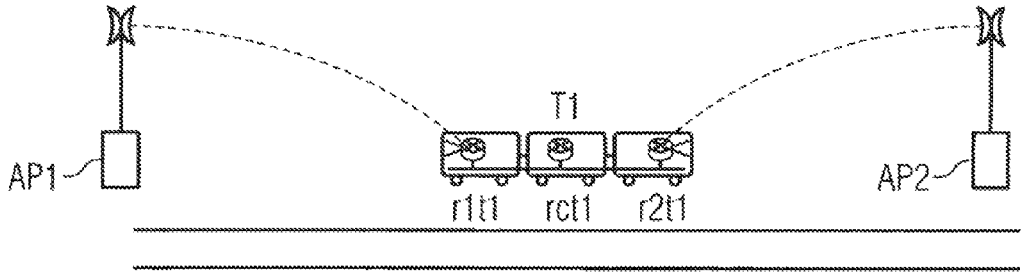
Figure 1C:
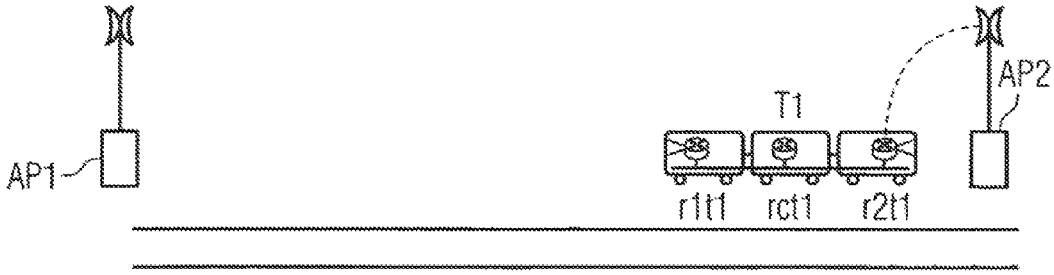

FIGS. 1A, 1B, 1C show the routing method according to the invention for routing data via three possible paths between a guided vehicle, in this case a train (T1), moving on one of two tracks (V1, V2) between at least a first and a second communication terminal (AP1, AP2) disposed on the ground along the track, said terminals being capable of exchanging data streams between a ground network (not shown) and at least one routing module (r1*t*1, rct1, r2*t*1) on board the vehicle. In this example, several types of routing module are possible, such as modules of the router and radio transmitter/receiver type (r1*t*1, r2*t*1) connected to the onboard communication network, itself comprising a central onboard router (rct1). Ideally, the radio modules (r1*t*1, r2*t*1) are disposed at the upstream/downstream extremities of the vehicle (such as a train) and therefore have different radio transmission qualities according to their distance, with communication elements (not onboard and external to said vehicle).

In the cases shown in FIGS. 1A and 1C, when the train (T1) is close to one of the radio communication terminals (r1*t*1 or r2*t*1), the quality of the signal received is very good (for example after the quality of the signal is assessed as being above a quality threshold predefined in the controller router rct1), the physical throughput rate on the channel is therefore increased.

In the case shown in FIG. 1B, when the train is approximately between the radio communication terminals, the radio coverage is effected such that the train, via one of its two routing means at each extremity on the front and rear of the train, may be in communication with the two terminals having a signal of medium quality. The physical throughput rate of each radio channel is then much lower than in the cases shown in FIGS. 1A and 1C.

The inventive method then proposes utilizing the two radio channels simultaneously to increase the throughput rate and to provide it to applications in a fully transparent way.

By way of example, the following situation may be envisaged, wherein

- in FIG. 1A, the quality measured for the activated radio link AP1-*r*1*t*1 is very good; the available throughput rate is 54M.
- in FIG. 1B, i.e. in the form commuted by routing to multiple simultaneous routing paths, the qualities measured for the activated radio links AP1-*r*1*t*1, AP2-*r*2*t*1 are of medium level; the throughput rate available for each link is 36M, or 72M in simultaneous mode according to the invention.
- in FIG. 1C, the quality measured for the activated radio link AP2-*r*2*t*1 is very good; the available throughput rate is 54M.

Figure 2:
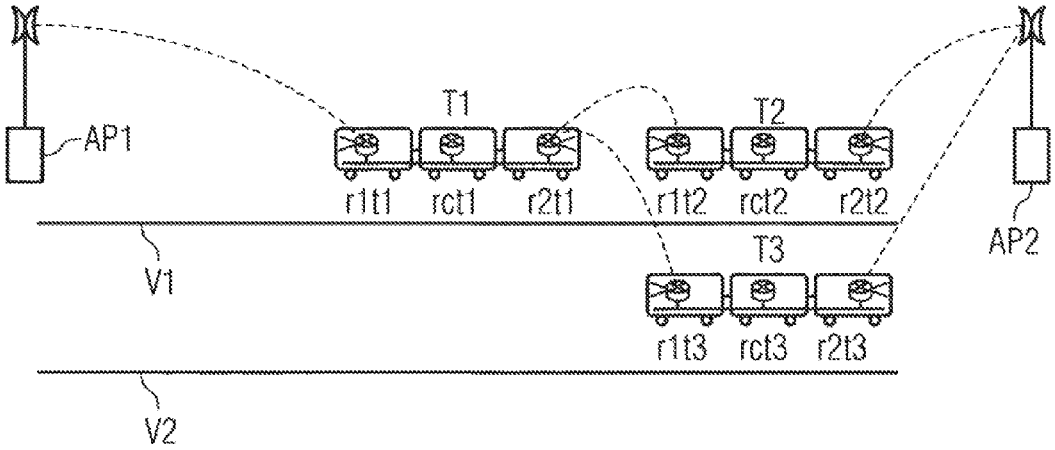

FIG. 2 is taken from FIG. 1B and is adapted to the routing method according to the invention for applications with high throughput rate for the train here known as the first train (T1) on its track (V1). Two other vehicles or second and third masking trains (T2, T3), traveling respectively on one of the tracks (V1, V2), then move between the train (T1) and the second communication terminal (AP2).

The presence of two masking trains greatly attenuates the level of the signal received by the first train (T1) from the second radio terminal (AP2). The direct path r2*t*1-AP2 from the routing means (r2*t*1) of the first train (T1) therefore no longer offers a sufficient throughput rate. By using mesh algorithms as based on an OLSR standard, at least one of the routing means (r1*t*2, r2*t*2, r3*t*1, r2*t*3) of the two masking trains may be utilized as relays between the routing means (r2*t*1) of the first train (T1) and the second radio terminal (AP2). The routing means are assumed here to be disposed in pairs upstream and downstream on each train according to the track direction.

The inventive method then permits the utilization of links made available by passing masking trains (T2 and T3), thus providing throughput rates far greater than the initial throughput rate for communicating with the ground network.

In this case, the routing from the train (T1) toward the ground network via the radio terminals (AP1, AP2) consists of several possible simultaneous paths: thus, by way of example, a high data stream throughput from the train toward the ground could be divided over the r1*t*1-AP1 path from an upstream side on the first train (T1) and over the r2*t*1-*r*1*t*2-*r*2*t*2-AP2 and/or r2*t*1-*r*1*t*3-*r*2*t*3-AP2 paths from the other side, downstream to the movement of the train. The invention proposes the simultaneous utilization of these different paths, this enabling the throughput rate offered to applications to be increased.

Accordingly, and by way of example, a situation may be envisaged wherein for the first train (T1), the quality measured for the activated radio link AP1-*r*1*t*1 is medium; the available throughput rate is 36M. The quality measured for the second radio link r2*t*1-AP2 is quite poor and may also have a low throughput rate of 6M. For data with a high throughput rate, these latter values are below the measurement thresholds capable of establishing a direct path to the second radio terminal (AP2). This is why the masking trains could serve as transmission relays to the first train (T1). The trains (T2, T3) which have thus become relays also have internal and external links (r1*t*2-*r*2*t*3-AP2, r1*t*3-*r*2*t*3-AP2) of very high quality and with a high throughput rate (54M), made possible by reason of their proximity to the second radio terminal (AP2).

Figure 3:
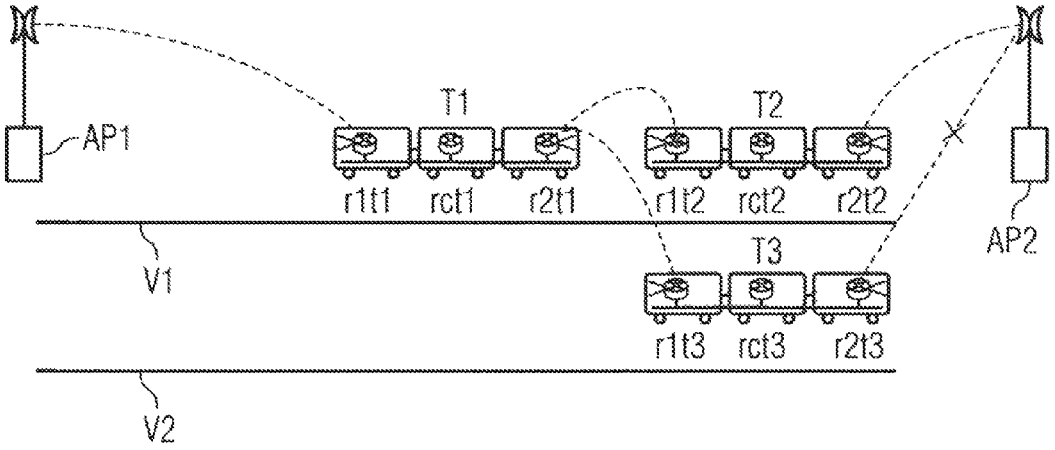

FIG. 3 is the same as FIG. 2 insofar as the routing method according to the invention, but in the case where the bandwidth occupation criteria for the first vehicle (T1) and the masking vehicles (T2, T3) must be taken into account.

In this case, the third train (T3) on the second track (V2) is already utilizing all the possible bandwidth from the link (r2*t*3-AP2) in order to transmit a high stream throughput between its second routing means downstream (r2*t*3) and the second radio terminal (AP2).

The inventive method then enables the first train (T1) to recognize the occupation of this link from the routing means (r2*t*3) and to route a portion of its data stream via an alternative link (r1*t*1-AP1) with the first routing means (r1*t*1) from the first train (T1) and the first radio terminal (AP1) as well as routing another portion of the data stream by utilizing the routing means from the second train (T2), and no longer those from the third train (T3) (or at most by utilizing one of the routing means (r1*t*3) that is still free of any measured and excessively restrictive occupation criterion with regard to a defined threshold according to the invention).

Figure 4A:
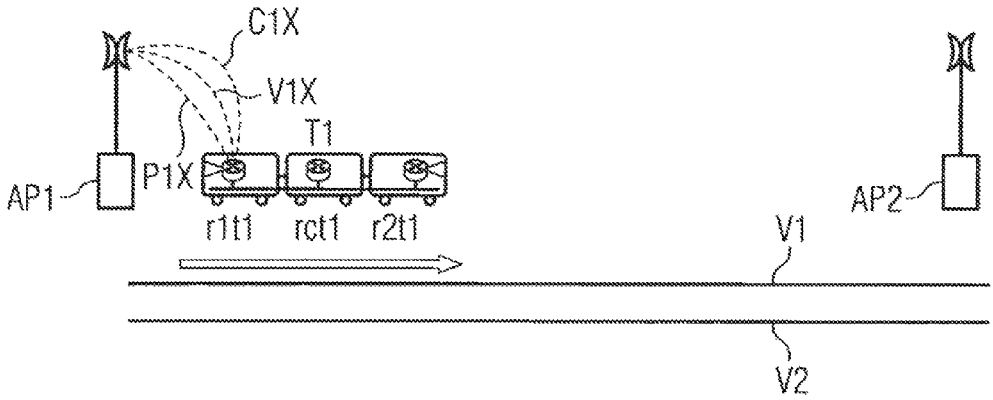
Figure 4B:
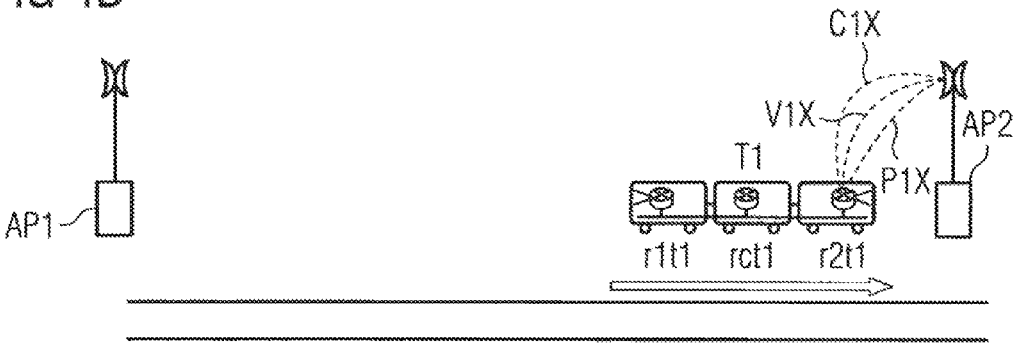
Figure 4C:
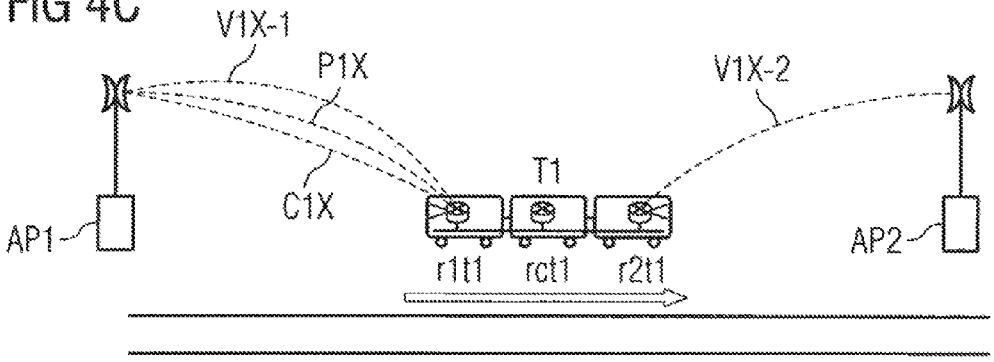

Analogously to the descriptive parts of the preceding figures, it is possible to provide a quantitative example to illustrate the conditions of such an occupation criterion according to FIG. 3:

- Quality of radio link AP1-*r*1*t*1 medium (acceptable quality threshold), throughput rate available: 36M (acceptable threshold for throughput rate)
- Quality of radio link AP2-*r*2*t*1 poor (below quality threshold), low throughput rate available: 6M (below throughput rate threshold, since masked by trains and even without masking, quality and throughput rates medium, therefore implementation of the inventive method necessary by means of the train relays T2, T3)
- Quality of radio link AP2-*r*2*t*3 very good, very high throughput rate available: 54M but band already occupied partially by traffic between the third train (T3) and the ground network (therefore occupation criterion exists!),
- Quality of radio link AP2-*r*2*t*2 very good, very high throughput rate available: 54M
- Quality of radio link r2*t*1-*r*1*t*2 very good, very high throughput rate available: 54M
- Quality of radio link r2*t*1-*r*1*t*3 very good, very high throughput rate available: 54M FIGS. 4A, 4B, 4C describe the routing method according to the invention with routing management for various data throughput rates for a vehicle, in this case the first train (T1) such as shown respectively in FIGS. 1A, 4C, 4B.

The inventive method also includes management of data streams according to their criticality and their throughput rate requirements.

It is conceivable, for example, that the data to be exchanged between the train and the ground network is of several types:

critical data having: minimal rate of loss, medium signal quality, no sharing of the load, possibility of transmitting redundant data via multiple separate paths, for example for reasons of availability (or even where needed for data security).

voice data having: minimal latency, therefore minimum number of jumps, no sharing of load.

video data having: maximum throughput rate, better signal quality, sharing of load.

All of these constraints together, combined with the throughput rate requirements, are taken into account in the invention in order to route data packets according to their application type as defined inter alia by criticality and an intrinsic throughput rate requirement.

For example, if the train (T1) (or another train Ti,==2, 3, 4 . . . ) wishes to transmit the following toward the ground network:

voice telephony data P1X (or PiX)

critical data C1X (or CiX)

video data V1X. (or ViX)

According to its position on the track and the immediate topology of the ground network and its radio terminals (and indeed also in the presence of other trains nearby), the routing paths resulting from the implementation of the inventive method and borrowed by the packets will be distinct in terms of their application type. In particular, this aspect is illustrated in FIG. 4C, in which—for the video data type V1X with high throughput rate—the two paths V1X-1, V1X-2 from the train (T1) toward each of the radio terminals (AP1, AP2) will be simultaneously activated, while for the two other data types P1X, C1X with a lower throughput rate, it will be possible to reserve just one of the paths (in this case with the first radio terminal AP1).

Figure 5A:
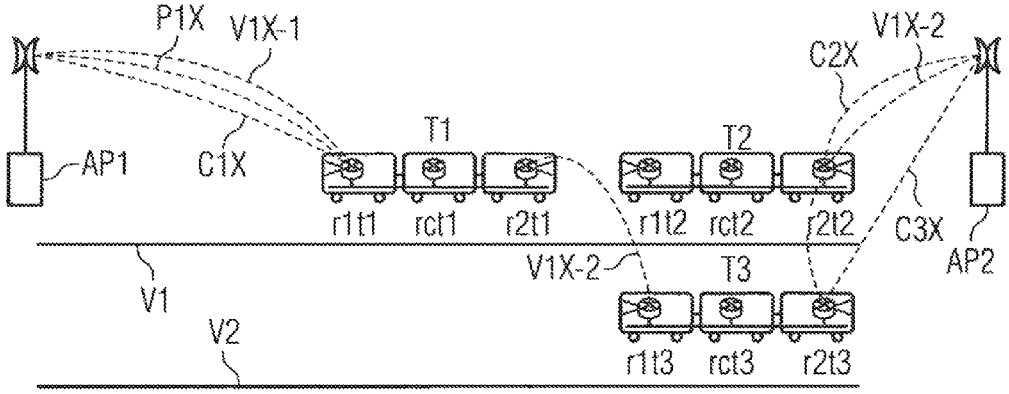
Figure 5B:
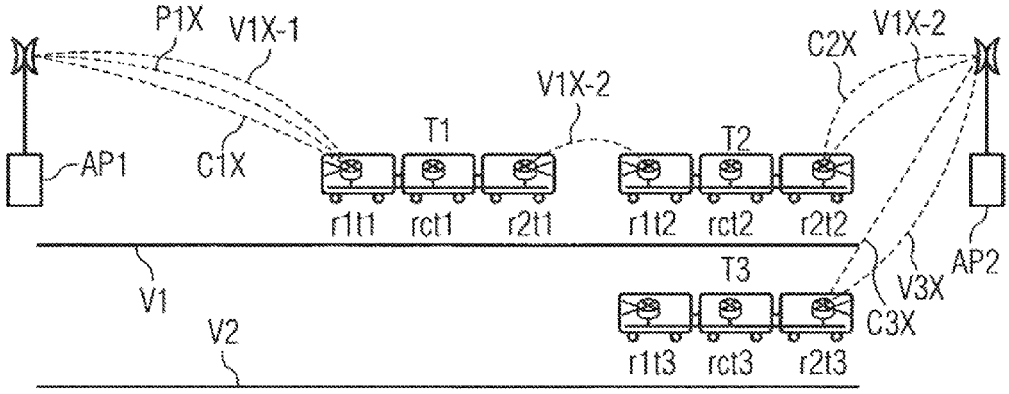
Figure 5C:
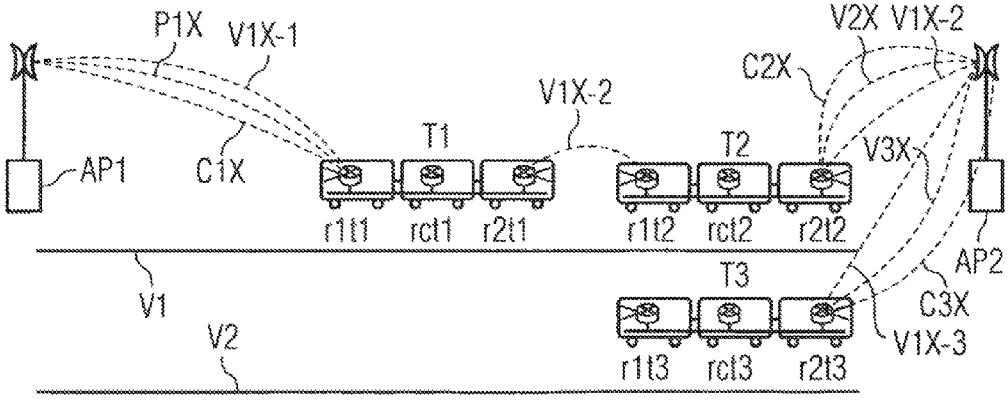

FIGS. 5A, 5B, 5C illustrate the routing method according to the invention with routing management for various data throughput rates for a vehicle and relay vehicles. In short, these latter figures resemble the preceding cases, in particular those taken from FIG. 2 or 3 (masking trains) as well as from FIG. 4C (data with various throughput rates).

FIGS. 5A, 5B, 5C thus describe the behavior of route choice algorithms affected by the invention in the presence of masking trains T2, T3 and according to the traffic between each train and the ground network.

FIG. 5A: case showing the presence of two masking trains (T2, T3) not transmitting video data ViX with high throughput rate. According to the invention, a video data bridge V1X-2 can therefore easily be activated between the first train (T1) and the second radio terminal (AP2), for example by diversion of the routing path via the third train (T3) to ensure better quality and a high train-ground throughput.

FIG. 5B: Case showing the presence of two masking trains, one of which (third train T3) transmits a video stream (V3X), given than each train is still transmitting its critical data (CiX). The initial routing bridge V1X-2 via the third train (T3) from FIG. 5A is then substituted with a separate routing bridge passing via the second train (T2) and not transmitting video data, and therefore still having sufficient throughput rate availability (and better than the third train T3) in order to channel video data (V1X) from the first train (T1).

FIG. 5C: Case showing the presence of two masking trains each transmitting a video stream (V2X, V3X), given than each train is still transmitting its critical data (CiX). Given than the throughput rates of the video channels of the masking trains acting as relays are medium, the inventive method will divide the channeling of the video data (V1X) from the first train (T1) over two parallel paths from the relay trains and the second radio terminal (AP2).

The invention claimed is:

1. A method for routing data between at least one guided vehicle and the ground network, wherein the vehicle moves on a track between at least a first and a second communication terminal disposed on the ground along the track, and wherein the terminals exchange data streams between a ground network and at least one routing module on board the vehicle, the method which comprises:

periodically carrying out a transmission quality measurement for a first signal between the first terminal and the routing module;

periodically carrying out a transmission quality measurement for a second signal between the second terminal and the routing module;

periodically carrying out a measurement of an available data throughput rate for the first signal between the ground network and the routing module;

periodically carrying out a measurement of an available data throughput rate for the second signal between the ground network and the routing module;

periodically determining a routing path for at least a portion of the data between the ground network and the routing module by at least one of the communication terminals if the routing path has a measured signal quality higher than a predetermined threshold and a data throughput rate higher than a predetermined threshold; and subdividing the routing path into several simultaneous and distinct data paths between the routing module on board the vehicle and the ground network, while the vehicle is moving, each having a bandwidth dependent on values measured by their transmission quality and their minimum guaranteed throughput rate.

2. The method according to claim 1, which comprises dividing the data transmitted into different data types having different throughput rate ranges.

3. The method according to claim 2, wherein the data types having different throughput rate ranges are selected from the group consisting of critical vehicle or traffic data, video data, and audio data.

4. The method according to claim 2, wherein, depending on the data type, each routing module divides a data transmission into different routing paths, choosing the paths according to their available transmission capacity and throughput rate demanded by each of the data types to be transmitted.

5. The method according to claim 1, which comprises channeling the routing path via at least one radio relay on board vehicles moving between the two communication terminals.

6. The method according to claim 1, which comprises subdividing the routing path into several separate paths and transmitting redundant data thereon.

7. The method according to claim 1, wherein one of the communication terminals is disposed in an additional vehicle.

8. A method of routing data transmissions, which comprises implementing the method according to claim 1 for routing data between a first vehicle and a second vehicle, and for implementing data in applications linked to vehicles.

9. A method for routing data between at least one guided vehicle and the ground network, wherein the vehicle moves on a track between at least a first and a second communication terminal disposed on the ground along the track, and wherein the terminals exchange data streams between a ground network and at least one routing module on board the vehicle, the method which comprises:

periodically carrying out a transmission quality measurement for a first signal between the first terminal and the routing module;

periodically carrying out a transmission quality measurement for a second signal between the second terminal and the routing module;

periodically carrying out a measurement of an available data throughput rate for the first signal between the ground network and the routing module;

periodically carrying out a measurement of an available data throughput rate for the second signal between the ground network and the routing module;

periodically determining a routing path for at least a portion of the data between the ground network and the routing module by at least one of the communication terminals if the routing path has a measured signal quality higher than a predetermined threshold and a data throughput rate higher than a predetermined threshold;

subdividing the routing path into several simultaneous and distinct data paths between the routing module on board the vehicle and the ground network, while the vehicle is moving, each having a bandwidth dependent on values measured by their transmission quality and their minimum guaranteed throughput rate; and if the track is frequented by at least one masking vehicle and the masking vehicle is present between the vehicle thus masked from one of the communication terminals and said terminal, diverting the routing path via a second routing module on board the masking vehicle, with the second routing module being selected under conditions such that:

a transmission quality measurement of a third signal between the second routing module and the communication terminal produces a measured signal quality higher than a predetermined threshold; and a measurement of the available data throughput rate of the third signal between the ground network and the second routing module produces a data throughput rate higher than a predetermined threshold.

* * * * *